US008607773B1

(12) United States Patent
Schultz

(10) Patent No.: US 8,607,773 B1
(45) Date of Patent: Dec. 17, 2013

(54) PNEUMATICALLY DRIVEN PROJECTILE WEAPON

(76) Inventor: Steven L. Schultz, Gilbertsville, KY (US)

( * ) Notice: Subject to any disclaimer, the term of this patent is extended or adjusted under 35 U.S.C. 154(b) by 24 days.

(21) Appl. No.: 13/488,227

(22) Filed: Jun. 4, 2012

(51) Int. Cl.
*F41B 5/12* (2006.01)
*F41B 7/00* (2006.01)
*F41B 11/00* (2013.01)

(52) U.S. Cl.
USPC ..... 124/25; 124/56; 124/61

(58) Field of Classification Search
USPC ..... 124/56, 61, 66, 16, 25
See application file for complete search history.

(56) References Cited

U.S. PATENT DOCUMENTS

| | | | | |
|---|---|---|---|---|
| 3,561,419 | A | 2/1971 | Cucuzza, Sr. | |
| 4,169,453 | A * | 10/1979 | Hunsicker | 124/20.1 |
| 4,466,417 | A * | 8/1984 | Mulot et al. | 124/25 |
| 4,682,559 | A * | 7/1987 | Schnitzer et al. | 114/295 |
| 5,133,331 | A * | 7/1992 | Hutchinson | 124/68 |
| 5,445,139 | A | 8/1995 | Bybee | |
| 5,749,348 | A | 5/1998 | Oviedo-Reyes | |
| 5,931,146 | A | 8/1999 | Schrader et al. | |
| 6,273,078 | B1 * | 8/2001 | Schwesinger | 124/16 |
| 6,286,496 | B1 | 9/2001 | Bednar | |
| 7,017,568 | B1 | 3/2006 | Smith | |
| 2009/0032002 | A1 | 2/2009 | Howard et al. | |
| 2010/0024791 | A1 * | 2/2010 | Romney | 124/65 |
| 2010/0212481 | A1 * | 8/2010 | Koth | 89/7 |
| 2011/0041820 | A1 | 2/2011 | Stanziale | |

FOREIGN PATENT DOCUMENTS

| | | |
|---|---|---|
| GB | 2 206 810 A | 1/1989 |

* cited by examiner

*Primary Examiner* — Bret Hayes
(74) *Attorney, Agent, or Firm* — Richard C. Litman

(57) ABSTRACT

The pneumatically driven projectile weapon combines the tensioned line of a conventional crossbow or archery bow with mechanical and pneumatic compression, thus increasing the power and accuracy of the weapon. A spring-biased cylinder is mounted within a hollow weapon stock, similar to a conventional rifle or shotgun stock, and is interconnected via an internal pulley system to the tensioned line. Firing tension in the line to launch a projectile, such as an arrow or the like, is created by compression of the spring-biased pneumatic cylinder.

17 Claims, 3 Drawing Sheets

PNEUMATICALLY DRIVEN PROJECTILE WEAPON

BACKGROUND OF THE INVENTION

1. Field of the Invention

The present invention relates to weapons, and particularly to a pneumatically driven projectile weapon (a cross between a crossbow and an air gun) combining a tensioned line with a spring-biased pneumatic cylinder to launch a projectile (an arrow or dart).

2. Description of the Related Art

A crossbow is a weapon having a bow mounted on a stock that shoots projectiles, similar to conventional arrows. A conventional crossbow is relatively bulky, due to the necessity of the bow portion, thus making it inefficient for carrying during hunting or other recreational or sport activities. Additionally, the crossbow, as with the conventional bow, is limited in firing power by the maximum tension of which the bow is capable of achieving. It would be desirable to combine the capabilities of a crossbow with the portability and convenience of a conventional hunting weapon, such as a rifle or shotgun, and to further increase firing power without the structural limitations of a conventional bow.

Thus, a pneumatically driven projectile weapon solving the aforementioned problems is desired.

SUMMARY OF THE INVENTION

The pneumatically driven projectile weapon includes a hollow weapon stock, similar to a conventional rifle or shotgun stock. A longitudinal track adapted for slidably receiving an arrow is defined in an upper end thereof. A retainer is slidably disposed within the longitudinal track. The retainer is adapted for releasably engaging a rear end of the arrow, similar to a conventional crossbow.

A spring-biased cylinder having opposed first and second ends is mounted within the hollow weapon stock and extends longitudinally therein. The spring-biased cylinder is preferably a pneumatic cylinder, thus allowing for both pneumatic and mechanical compression and expansion, although it should be understood that the cylinder may be solely spring-biased. A first pair of pulleys is mounted within the hollow weapon stock adjacent the first end of the spring-biased cylinder. The pulleys are spaced apart and are positioned adjacent laterally opposed sides, respectively, of the first end of the spring-biased cylinder.

A second pair of pulleys is mounted on the second end of the spring-biased cylinder. The pulleys of the second pair are similarly spaced apart and positioned on laterally opposed sides, respectively, of the second end of the spring-biased cylinder. A cable has opposed ends fixed within the hollow weapon stock adjacent and beneath the first pair of pulleys. First portions of the cable adjacent the ends thereof are partially wound about the second pair of pulleys, and second portions of the cable are partially wound about the first pair of pulleys. A central portion of the cable is secured to the sliding retainer.

The sliding retainer is releasably held in the rear end of the longitudinal track by a trigger-actuated release, as in a conventional crossbow. When the retainer is held in the rear end of the longitudinal track by the release, the cable is tensioned to compress the spring-biased cylinder. When the retainer is released, longitudinal expansion of the spring-biased cylinder drives the retainer to slide within the longitudinal track toward a front end thereof, imparting forward momentum to the arrow.

These and other features of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
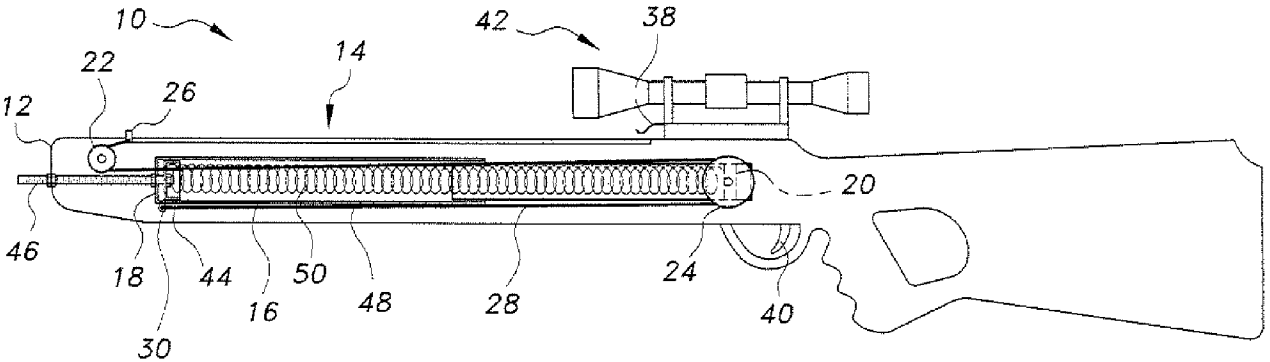
FIG. 1 is a diagrammatic side view of a pneumatically driven projectile weapon according to the present invention, showing the cylinder extended.
Figure 2:
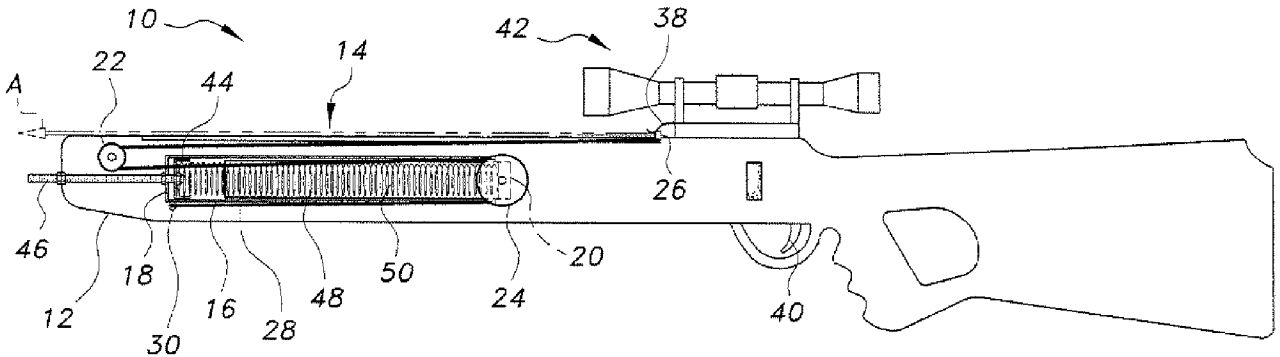
FIG. 2 is a diagrammatic side view of a pneumatically driven projectile weapon according to the present invention, showing the cylinder compressed.

As best shown in FIGS. 1 and 2, the pneumatically driven projectile weapon 10 includes a hollow weapon stock 12, similar to a conventional rifle or shotgun stock. A longitudinal track 14 adapted for slidably receiving an arrow A (shown in FIG. 2) is defined in an upper surface of the stock 12. A retainer 26 is slidably disposed within the longitudinal track 14. The retainer 26 is adapted for releasably engaging a rear end of the arrow A, similar to a conventional crossbow. It should be understood that the weapon stock 12, along with the attached scope 42, are shown for exemplary purposes only, and that any desired style or size of weapon stock (or any desired type of attachment) may be utilized.

A spring-biased cylinder 16 having opposed first and second ends 18, 20 is mounted within the hollow weapon stock 12 and extends longitudinally therein. The spring-biased cylinder 16 is preferably a pneumatic cylinder, thus allowing for both pneumatic and mechanical compression and expansion, although it should be understood that the cylinder may be solely spring-biased. The cylinder 16 comprises two tubes, each of the tubes having a closed end, one of the tubes being slidable within the other. The first end 18 of the spring-biased cylinder 16 is fixed within the hollow weapon stock 12, and the second end 20 is free to move in axially during expansion and compression of cylinder 16, sliding within the first end 18.

A first pair of pulleys 22 is mounted within the hollow weapon stock 12 adjacent the first end 18 of the spring-biased cylinder 16. The pulleys 22 are spaced apart and are positioned adjacent laterally opposed sides, respectively, of the first end of the spring-biased cylinder 16. A second pair of pulleys 24 is mounted on the second end 20 of the spring-biased cylinder 16. The pulleys 24 of the second pair are similarly spaced apart and mounted on laterally opposed sides, respectively, of the second end 20 of the spring-biased cylinder 16.

Figure 3:
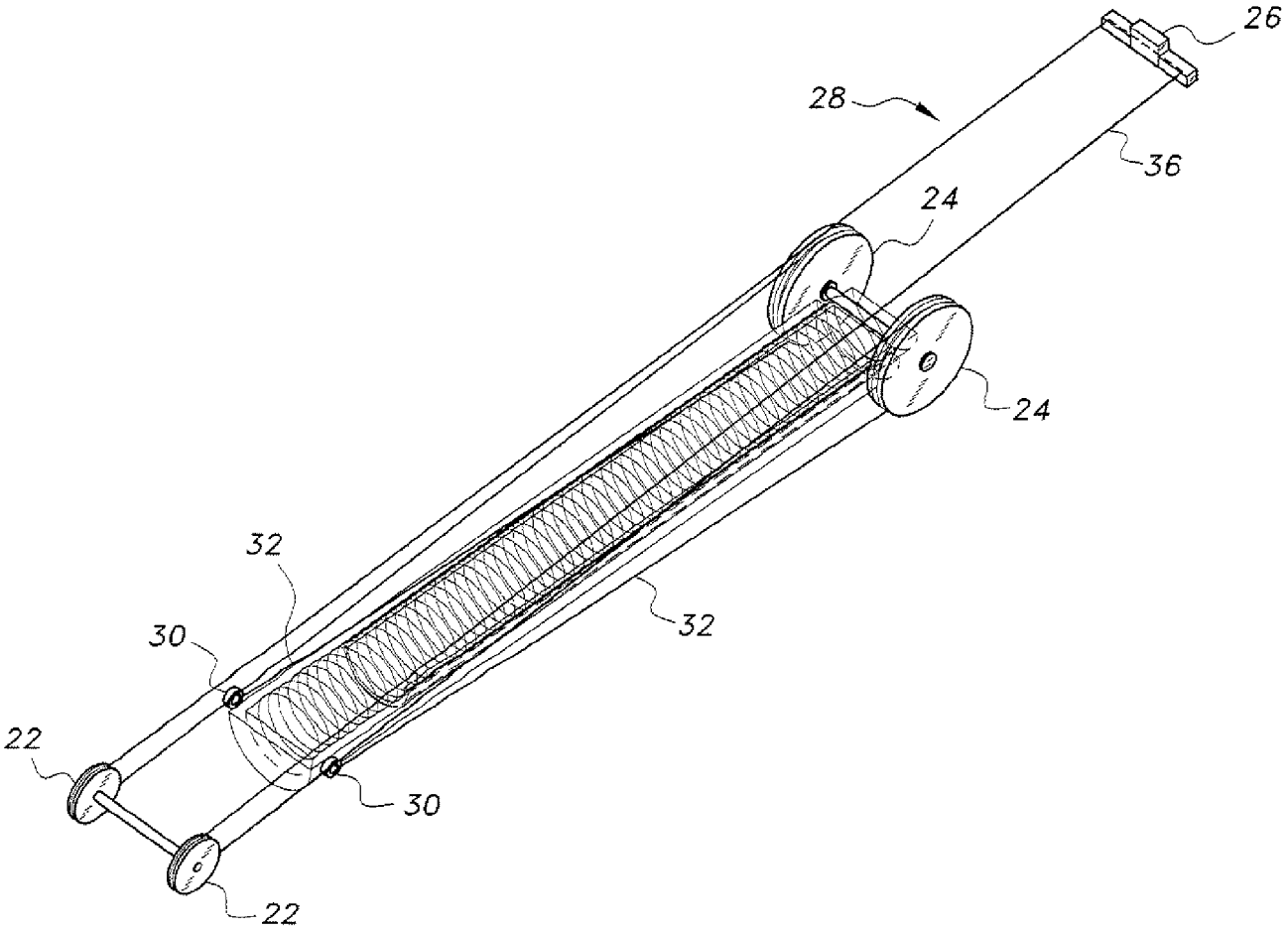
FIG. 3 is a diagrammatic perspective view of a cable and pulley mechanism of the pneumatically driven projectile weapon.

A cable 28 has opposed ends 30 fixed within the hollow weapon stock 12 adjacent and beneath the first pair of pulleys 22. The configuration of the cable 28 with respect to the pulleys is shown diagrammatically in FIG. 3. First portions 32 of the cable 28 adjacent the ends 30 are partially wound about the second pair of pulleys 24, and second portions 34 of the cable 28 are partially wound about the first pair of pulleys 22. A central portion 36 of the cable 28 is secured to the sliding retainer 26.

The sliding retainer 26 is releasably held in the rear end of the longitudinal track 14 by a trigger-actuated release 38 (actuated by trigger 40), as in a conventional crossbow. Such firing mechanisms are known in the field of crossbows. Examples of such firing mechanisms are shown in U.S. Pat. Nos. 3,561,419; 5,749,348; and 6,286,496, each of which is hereby incorporated by reference in its entirety. When the retainer 26 is held in the rear end of the longitudinal track 14 by the release 38, the cable 28 is drawn over the pulley pairs 22, 24, compressing the compression spring 50 within the cylinder 16 and placing the cable 28 under tension. When the retainer 26 is released, the compression spring 50 is released so that longitudinal expansion of the spring-biased cylinder 16 drives the retainer 26 to slide within the longitudinal track 14 toward the front end thereof, imparting forward momentum to the arrow A.

It should be understood that the weapon 10 may be used to fire any suitable type of projectile, rather than only the exemplary arrow A shown in FIG. 2. For example, weapon 10 may be adapted to fire bolts or quarrels, as are commonly shot from conventional crossbows.

Further, as shown in FIGS. 1 and 2, an adjustable sliding holder 44 may be mounted within the first end of the spring-biased cylinder. A first end of the compression spring 50 engages the adjustable sliding holder 44. The second end of the compression spring 50 is fixed to the slidable second end 20 of the spring-biased cylinder 16. The adjustable sliding holder 44 is longitudinally adjustable to selectively adjust the length to which the compression spring 50 expands, thus allowing for fine control over the firing power of the weapon 10. The adjustable sliding holder 44 may be adjusted by a threaded member 46 extending through a front end of the hollow weapon stock and through the first end 18 of the internally spring-biased cylinder 16, as shown, to contact the adjustable sliding holder 44.

Figure 4:
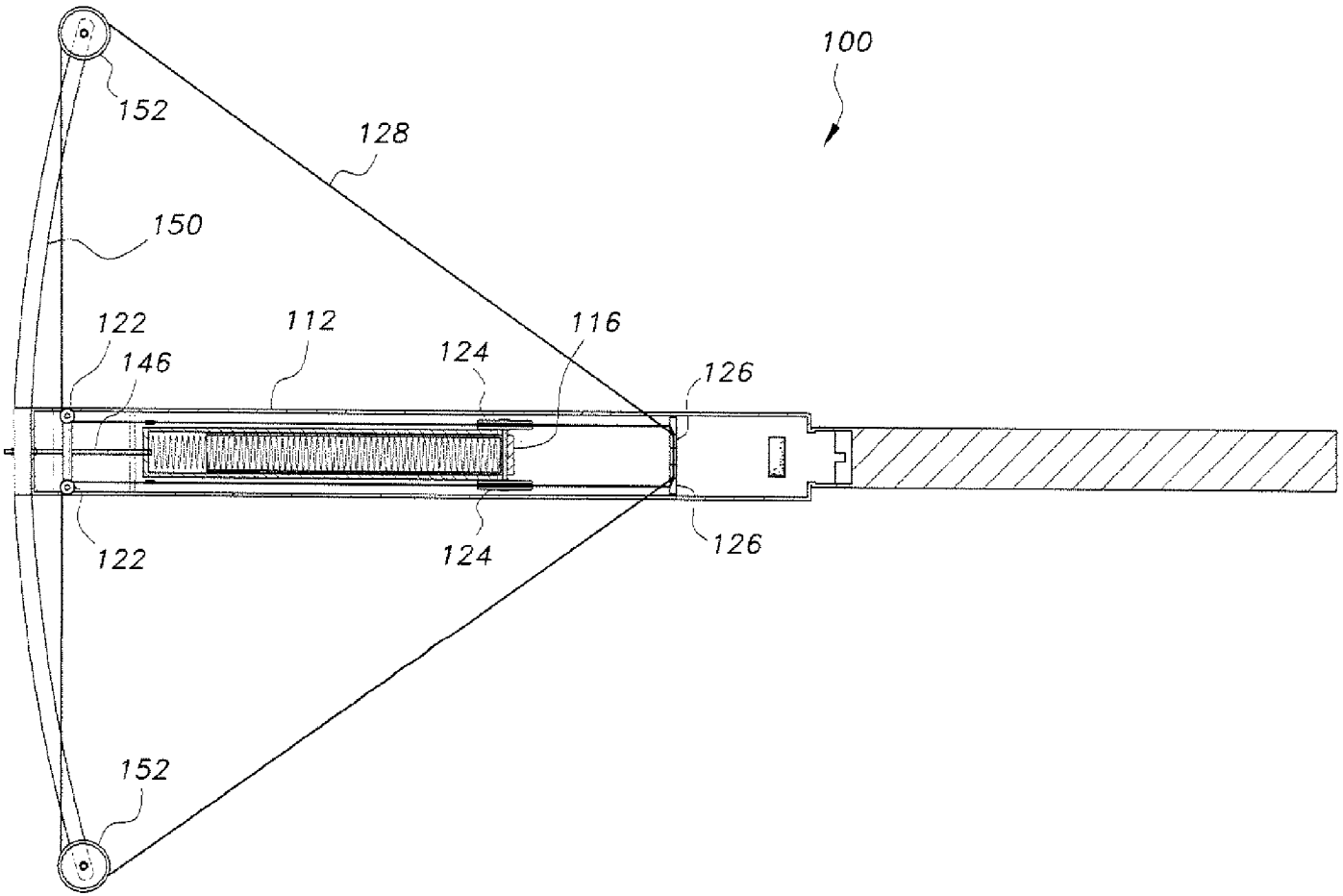
FIG. 4 is a diagrammatic top view of an alternative embodiment of a pneumatically driven projectile weapon according to the present invention.

In the alternative embodiment of FIG. 4, the weapon 100 is configured similar to weapon 10, including a hollow stock 112, a first pair of pulleys 122, a second pair of pulleys 124, an spring-biased cylinder 116, a cable 128, and a sliding retainer 126, each of which functions similar to that described above with regard to the weapon 10. However, in the embodiment of FIG. 4, a bow 150, similar to that of a conventional crossbow, has been added. The bow 150 has a pair of laterally opposed ends and a central portion secured to a front end of the hollow weapon stock 112. A third pair of pulleys 152 is rotatably mounted to the opposed ends of the bow 150 so that the central portion of the cable 128 is partially wound about the third pair of pulleys 152 external to the hollow weapon stock 112, similar to a conventional crossbow. In this embodiment, the pulleys 124 of the first pair rotate about a lateral axis, as in the previous embodiment. However, the second and third pairs of pulleys 122, 152 rotate about vertical axes orthogonal to the lateral axis and the longitudinal axis of the stock 112.

It is to be understood that the present invention is not limited to the embodiments described above, but encompasses any and all embodiments within the scope of the following claims.

I claim:

1. A projectile weapon, comprising:

a hollow weapon stock having an upper surface and a longitudinal track defined in the upper surface adapted for slidably receiving an arrow;

a retainer slidably disposed within the longitudinal track, the retainer being adapted for releasably engaging a rear end of the arrow, the retainer being slidable between a cocked position drawn medially on the stock and a firing position for propelling the arrow from the stock;

an extensible cylinder having opposed first and second ends, the cylinder being mounted within the hollow weapon stock and extending longitudinally below the longitudinal track, the first end being fixed to the stock, the second end being slidable in the first end;

a first pair of pulleys mounted within the hollow weapon stock adjacent the first end of the cylinder, the pulleys being spaced apart and positioned adjacent laterally opposed sides, respectively, of the first end of the cylinder;

a second pair of pulleys mounted on the second end of the cylinder, the pulleys of the second pair being spaced apart and positioned on laterally opposed sides, respectively, of the second end of the cylinder;

a cable having opposed ends fixed within the hollow weapon stock adjacent and beneath the first pair of pulleys, the cable having first portions adjacent the ends of the cable partially wound about the second pair of pulleys, the cable having second portions partially wound about the first pair of pulleys, and a central portion secured to the retainer; and a trigger-actuated release disposed on the stock, the release selectively engaging the retainer in the cocked position to prevent firing the arrow and releasing the retainer in the firing position.

2. The projectile weapon as recited in claim 1, further comprising a compression spring disposed in said cylinder, the spring biasing said retainer to the firing position, the spring being compressed by said cable and said pulleys when said retainer is drawn to the cocked position and held in the cocked position by said trigger actuated release, the spring expanding to cause the retainer to propel the arrow in the firing position.

3. The projectile weapon as recited in claim 2, further comprising an adjustable sliding holder mounted within the first end of said cylinder, said spring having a first end engaging the adjustable sliding holder and a second end fixed to the second end of said cylinder.

4. The projectile weapon as recited in claim 3, further comprising means for adjustably positioning the adjustable sliding holder to selectively adjust tension in the spring.

5. The projectile weapon as recited in claim 4, wherein said means for adjustably positioning the adjustable sliding holder comprises a threaded member extending through a front end of said hollow weapon stock and through the first end of said cylinder to contact the adjustable sliding holder.

6. The projectile weapon as recited in claim 1, wherein said cylinder comprises a pneumatic cylinder.

7. A projectile weapon, comprising:

a hollow weapon stock having an upper surface and a longitudinal track defined in the upper surface adapted for slidably receiving an arrow;

a retainer slidably disposed within the longitudinal track, the retainer being adapted for releasably engaging a rear end of the arrow, the retainer being slidable between a cocked position drawn medially on the stock and a firing position for propelling the arrow from the stock;

an extensible cylinder having opposed first and second ends, the cylinder being mounted within the hollow weapon stock and extending longitudinally below the longitudinal track, the first end being fixed to the stock, the second end being slidable in the first end;

a compression spring disposed in the cylinder, the spring having an expanded position biasing the retainer to the firing position and a compressed position when the retainer is in the cocked position;

a first pair of pulleys mounted within the hollow weapon stock adjacent the first end of the cylinder, the pulleys being spaced apart and positioned adjacent laterally opposed sides, respectively, of the first end of the cylinder;

a second pair of pulleys mounted on the second end of the cylinder, the pulleys of the second pair being spaced apart and positioned on laterally opposed sides, respectively, of the second end of the cylinder;

a cable having opposed ends fixed within the hollow weapon stock adjacent and beneath the first pair of pulleys, the cable having first portions adjacent the ends of the cable partially wound about the second pair of pulleys, the cable having second portions partially wound about the first pair of pulleys, and a central portion secured to the retainer; and a trigger-actuated release disposed on the stock, the release selectively engaging the retainer in the cocked position to prevent firing the arrow and releasing the retainer in the firing position, whereby expansion of the spring propels the arrow.

8. The projectile weapon as recited in claim 7, wherein said cylinder comprises a pneumatic cylinder.

9. The projectile weapon as recited in claim 7, further comprising an adjustable sliding holder mounted within the first end of said cylinder, the spring having a first end engaging the adjustable sliding holder and a second end fixed to the second end of said cylinder.

10. The projectile weapon as recited in claim 9, further comprising means for adjustably positioning the adjustable sliding holder to selectively adjust tension in the spring.

11. The projectile weapon as recited in claim 10, wherein said means for adjustably positioning the adjustable sliding holder comprises a threaded member extending through a front end of said hollow weapon stock and through the first end of said cylinder to contact the adjustable sliding holder.

12. A projectile weapon, comprising:

a hollow weapon stock having an upper surface and a longitudinal track defined in the upper surface adapted for slidably receiving an arrow;

a retainer slidably disposed within the longitudinal track, the retainer being adapted for releasably engaging a rear end of the arrow, the retainer being slidable between a cocked position drawn medially on the stock and a firing position for propelling the arrow from the stock;

an extensible cylinder having opposed first and second ends, the cylinder being mounted within the hollow weapon stock and extending longitudinally below the longitudinal track, the first end being fixed to the stock, the second end being slidable in the first end;

a compression spring disposed in the cylinder, the spring having an expanded position biasing the retainer to the firing position and a compressed position when the retainer is in the cocked position;

a first pair of pulleys mounted within the hollow weapon stock adjacent the first end of the cylinder, the pulleys being spaced apart and positioned adjacent laterally opposed sides, respectively, of the first end of the cylinder;

a second pair of pulleys mounted on the second end of the cylinder, the pulleys of the second pair being spaced apart and positioned on laterally opposed sides, respectively, of the second end of the cylinder;

a cable having opposed ends fixed within the hollow weapon stock adjacent and beneath the first pair of pulleys, the cable having first portions adjacent the ends of the cable partially wound about the second pair of pulleys, the cable having second portions partially wound about the first pair of pulleys, and a central portion secured to the retainer;

a trigger-actuated release disposed on the stock, the release selectively engaging the retainer in the cocked position to prevent firing the arrow and releasing the retainer in the firing position, whereby expansion of the spring propels the arrow;

a bow having a pair of laterally opposed ends and a central portion secured to a front end of the hollow weapon stock; and a third pair of pulleys mounted to the pair of laterally opposed ends of the bow, the central portion of the cable being partially wound about the third pair of pulleys external to the hollow weapon stock.

13. The projectile weapon as recited in claim 12, wherein said cylinder comprises a pneumatic cylinder.

14. The projectile weapon as recited in claim 12, further comprising an adjustable sliding holder mounted within the first end of said cylinder, said spring having a first end engaging the adjustable sliding holder and a second end secured to the second end of said cylinder.

15. The projectile weapon as recited in claim 14, further comprising means for adjustably positioning the adjustable sliding holder to selectively adjust tension in the spring.

16. The projectile weapon as recited in claim 15, wherein said means for adjustably positioning the adjustable sliding holder comprises a threaded member extending through a front end of said hollow weapon stock and through the first end of said cylinder to contact the adjustable sliding holder.

17. The projectile weapon as recited in claim 12, whereby said first pair of pulleys rotate about a lateral axis and said second and third pairs of pulleys rotate about a vertical axis orthogonal to the lateral axis and orthogonal to a longitudinal axis of said stock.

* * * * *